United States Patent [19]

Ishikawa et al.

[11] Patent Number: 4,817,367

[45] Date of Patent: Apr. 4, 1989

[54] APPARATUS FOR MANUFACTURING GELATIN CAPSULE AND METHOD THEREFOR

[75] Inventors: Toshimitsu Ishikawa; Katsuhide Tamura, both of Shizuoka, Japan

[73] Assignee: Sankyo Co., Ltd., Fuji, Japan

[21] Appl. No.: 85,725

[22] Filed: Aug. 10, 1987

[51] Int. Cl.[4] ..... B65B 9/04

[52] U.S. Cl. ..... 53/454; 53/553; 53/560

[58] Field of Search ..... 53/454, 560, 559, 453, 53/546, 553, 554, 555

[56] References Cited

U.S. PATENT DOCUMENTS

| | | | |
|---|---|---|---|
| 2,323,581 | 7/1943 | Weckesser | 53/560 X |
| 2,431,141 | 11/1947 | Scherer | 53/560 |
| 2,663,129 | 12/1953 | Donofrio | 53/560 |
| 3,092,942 | 6/1963 | Chasman | 53/560 |
| 4,567,714 | 2/1986 | Chasman | 53/454 X |

*Primary Examiner*—James F. Coan

*Attorney, Agent, or Firm*—Oblon, Fisher, Spivak, McClelland & Maier

[57] ABSTRACT

Apparatus for manufacturing gelatin capsules and method therefor are provided. The apparatus comprises a gelatin sheet forming mechanism which includes a rotatable cooling drum, a gelatin capsule forming mechanism which includes a pair of die rolls and a gelatin capsule recovery mechanism. The inner space of the cooling drum is provided with a coolant. The thickness of the gelatin sheet and the gap between the die rolls are numerically indicated respectively. The driving mechanism for the gelatin capsule recovery mechanism is independent from the other driving mechanism provided in the apparatus.

7 Claims, 13 Drawing Sheets

APPARATUS FOR MANUFACTURING GELATIN CAPSULE AND METHOD THEREFOR

FIELD OF THE INVENTION

This invention relates to an apparatus for making drugs or nutrition promoting medicines packed in gelatin capsule formed from gelatin sheets.

PRIOR ART

Various gelatin capsules containing liquefied drugs, medicines for promoting nutrition, granular drugs, and others (generally referred to as "raw liquid" in this specification for convenience) in capsules formed of soft gelatin to make them easier to take are available on the market. To make such gelatin capsules, melted gelatin is formed into sheets and the sheets are formed into spindle-shaped capsules with a pair of die rolls. At this forming stage, the capsules are filled with raw liquid. To form gelatin sheets with such an apparatus, melted gelatin is spread and coated on a rotating drum and cooling air is blown on the coated gelatin surface so that the melted gelatin becomes suitable for processing.

In such prior art, the cooling air is not specifically recovered and the operating cost for refrigerating equipment to supply the cooling air is very high, resulting in a total manufacturing cost which is very high. In addition to such high cost, this kind of product requires very strict sanitary controls since it is related with drugs, etc. which are taken by men and the cooling air has to be very clean, i.e. not containing any sundry bacteria. Therefore, filters and other air cleaning systems also have to be very strictly controlled, and also very careful control of manufacturing processes is required for this reason.

In the manufacture of gelatin capsules, it is the properties of gelatin sheets, especially the thickness of sheets and contact pressure between a pair of die rolls used for forming gelatin capsules which determines the quality of gelatin capsules.

Adjustment for that reason previously depended mostly on the sense of skilled workers. For instance, whether sheet forming was satisfactory or not judged by measuring the formed sheet thickness, adjustment was repeated based on this measurement until satisfactory sheet thickness was obtained, and manufacturing was begun only after specified properties were obtained. The same procedure was applied concerning the contact pressure of a pair of die rolls. While observing capsules manufactured in the preparatory stage, workers set up the pressure of die rolls according to their sense of the situation. By such a method, materials were used wastefully in the preparatory stage before starting production, skilled workers were indispensable to obtain satisfactory products, and production was interfered with when such skilled workers were unavailable.

In such a type of gelatin capsule manufacturing processing, formed gelatin capsules were naturally dropped when being taken out after the forming process. If gelatin capsules can not be completely separated from a gelatin sheet, or have been caught by the sheet, they may be retained on the die roll forming dies or remain stuck to a blank sheet after being punched out. Therefore, scraping brushes were installed in contact with the die rolls and with a blank sheet to send out capsules. However, such brushes were driven with the same source of power as the pair of die rolls described above and could not be adjusted or checked independently, leaving no possibility of improvement with respect to manufacturing control.

SUMMARY OF THE INVENTION

This invention intends to eliminate such above disadvantages of the prior art. Its objects are to reduce manufacturing costs and provide easier means for controlling sanitary production by discontinuing the cooling air blowing process to cool gelatin sheet by employing a method of cooling melted gelatin with a rotary drum containing cooling medium in it.

In a preferred embodiment, adjustment in the sheet forming unit and pressure adjusting condition for manufacture of capsules with a pair of die rolls are digitally indicated on a gauge and, based on specified numeral data, or according to such accumulated data, effective adjustment can be made. Units to take out capsules manufactured in this way are driven with a driving mechanism independent of that of the pair of die rolls.

According to this invention, there is provided an apparatus for manufacturing a gelatin capsule comprising a gelatin sheet forming means which allows a predetermined amount of melted gelatin to flow continuously onto a rotary drum, cools the gelatin on the drum while transmitting it, and forms the gelatin into a sheet shape, wherein said rotary drum is a cooling drum and into which cooling media has been supplied, a gelatin capsule forming means to supply objects to be contained in the capsule between two gelatin sheets formed by said gelatin sheet forming means while supplying the two gelatin sheets between a pair of die rolls having capsule forming dies on the surface thereof and form gelatin capsules containing said object, and a gelatin capsule recovery means to recover gelatin capsules formed by the gelatin capsule forming means.

An another aspect of this invention, there is provided a method for manufacturing gelatin capsule comprising a process which allows a predetermined amount of melted gelatin to flow continuously onto a rotary drum, cool the gelatin on the said drum with the rotary drum into which cooling media has been supplied while transferring the gelatin on the said drum with this rotary drum and form the gelatin into sheet form, a process to supply objects to be contained in the capsules between two gelatin sheets while supplying said two gelatin sheets between a pair of die rolls having capsule forming dies on the surface thereof, and form gelatin capsules containing the said objects, and a process to recover the formed gelatin capsules.

In the preferred embodiment, said gelatin sheet forming mechanism is provided with a gauge to numerically indicate the melted gelatin which flows onto the said rotary drum. The pair of die rolls are disposed so as to bring one die roll in contact with the other die roll under pressure, and a pressure gauge to numerically indicate the amount of pressure are provided on the said gelatin capsule forming mechanism. In the preferred embodiment, the mechanism to recover formed capsules is driven with a driving mechanism independently of the said pair of die rolls.

DETAILED DESCRIPTION OF THE PREFERRED EMBODIMENT

Figure 2:
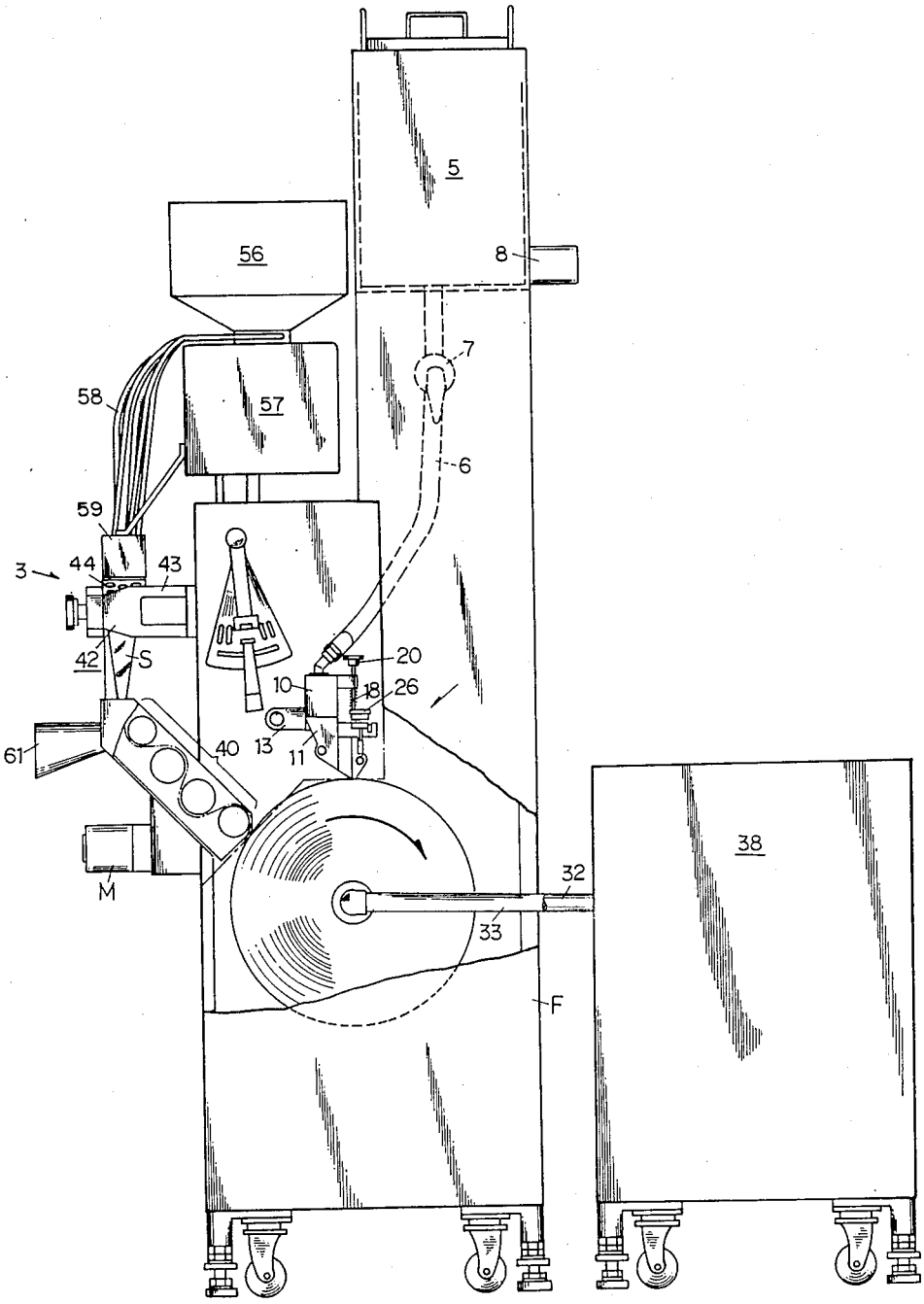
FIG. 2 is a top view of the same apparatus.
Figure 3:
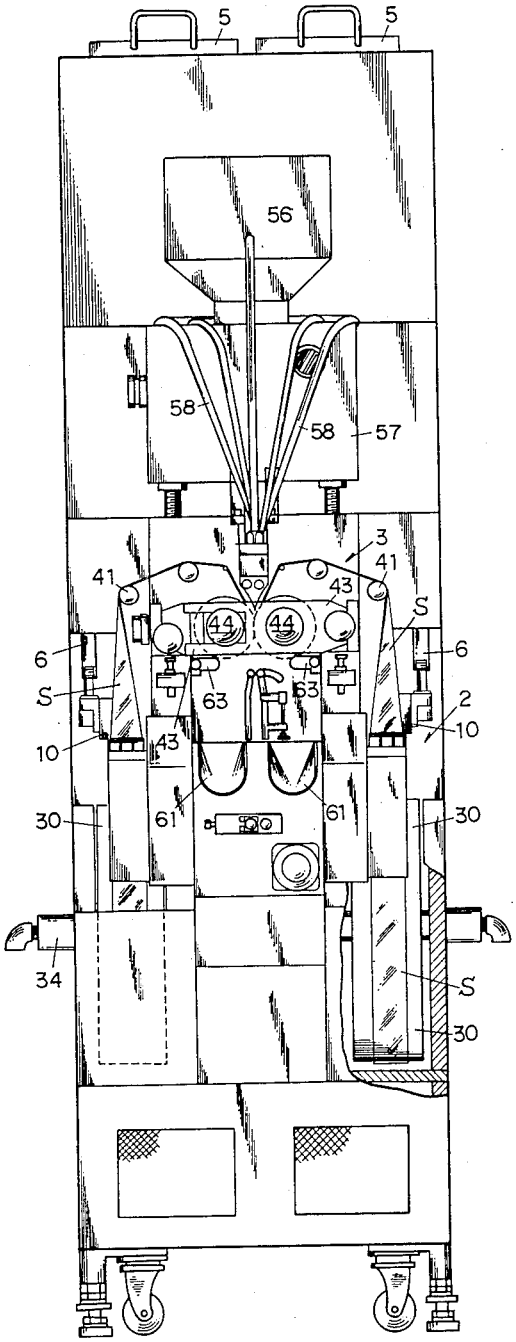
FIG. 3 is a front view of the same apparatus.

An embodiment of the present invention will now be described in detail with reference to the accompanying drawings. A gelatin capsule manufacturing system 1 comprised of three main systems—a sheet forming unit 2, a capsule forming unit 3, and a capsule recovery unit 4 is provided. These systems are installed on the frame F. First, the sheet forming unit 2 will be described (see FIGS. 1 to 3). Two gelatin sheets S are supplied from opposite directions to the said capsule forming unit 3 and formed into a spindle-shape via a pair of sheet forming units 2 installed on the right and left of the frame F. However, the sheet forming unit 2 is not always limited to such a construction. For example, it is possible to form gelatin sheets with one sheet forming unit 2 and cut the sheet into two parts while supplying it to the capsule forming unit 3. First, a gelatin tank 5 is provided above the said sheet forming unit 2. This tank contains melted gelatin. This embodiment has a relatively compact apparatus suitable to relatively small production amounts. In order to make the apparatus suitable to mass production, a gelatin hopper, etc. may be used instead of the gelatin tank 5. A downward supply hose 6 provided with a valve 7 is connected to this gelatin tank 5. A heater 8 is provided in the gelatin tank 5 to melt the gelatin. Gelatin is supplied from the supply hose 6 of the gelatin tank 5 to a spreader box 10 below.

Figure 4:
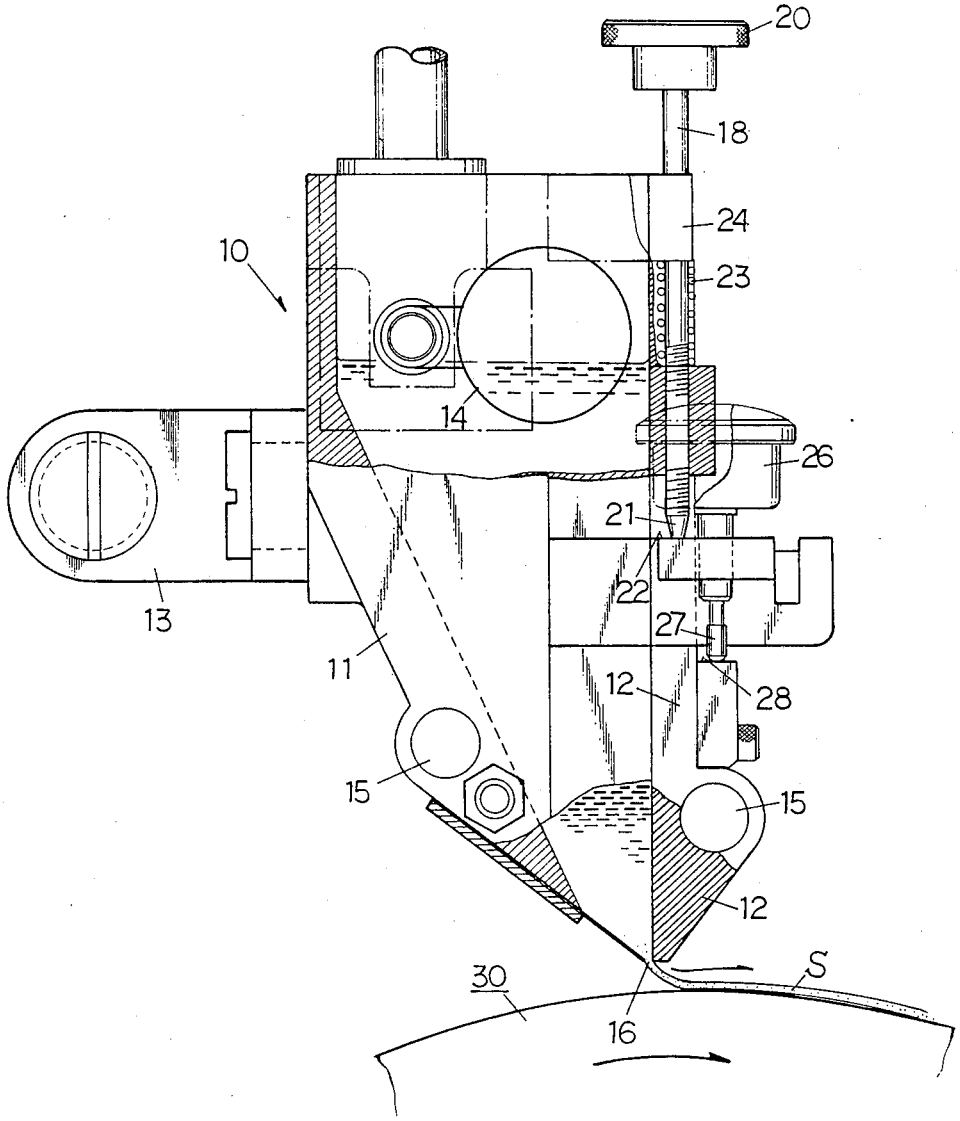
FIG. 4 is a side view of the spreader box of the said apparatus.
Figure 5:
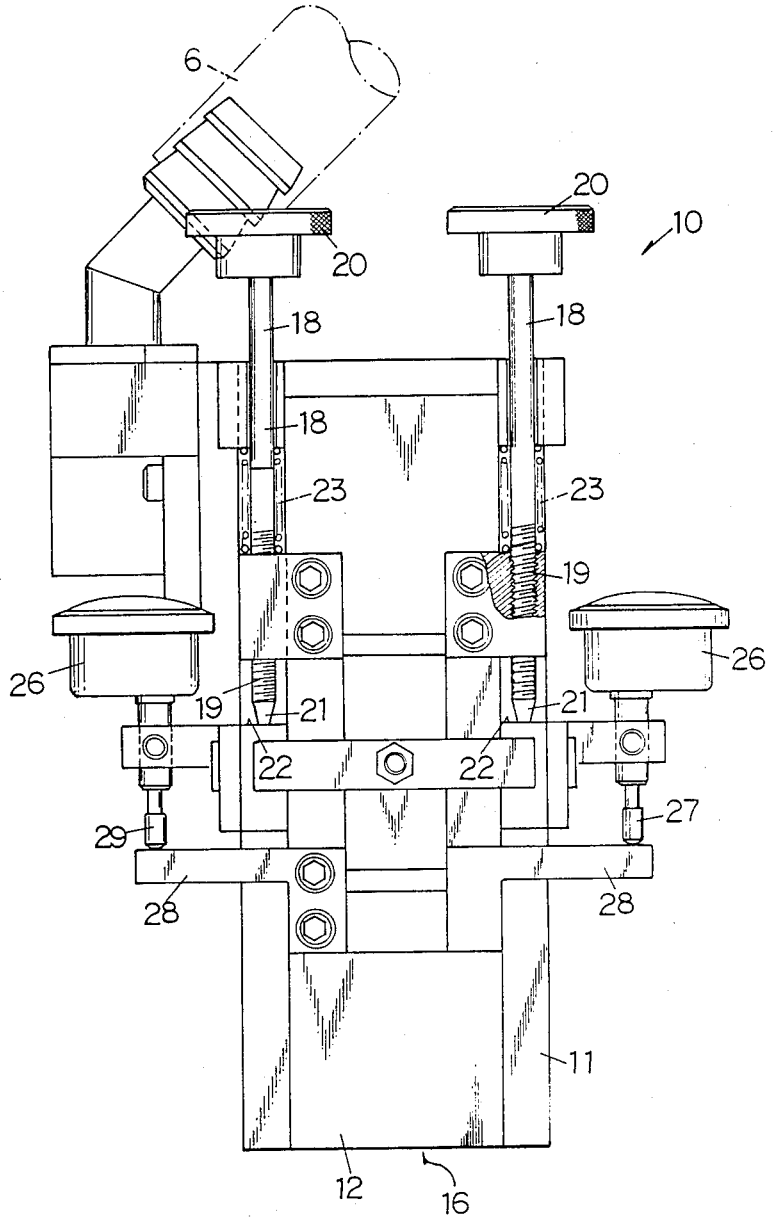
FIG. 5 is a front view of the spreader box.
Figure 6:
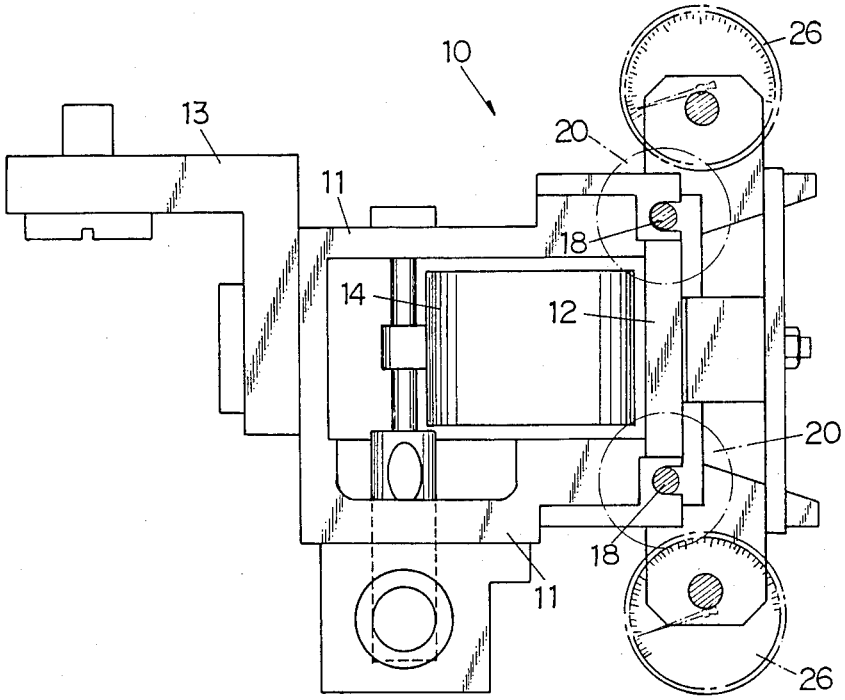
FIG. 6 is a plan of the spreader box.

The spreader box 10 will be explained below in more detail. As shown in FIGS. 4, 5 and 6, the side of the spreader box 10 is approximately wedge-shaped. The spread box 10 comprises the main body 11 and an adjusting sheathing 12 movably mounted to its front and the main body 11 is fixed to the frame F through the fixing bracket 13. A float valve 14 is provided in the main body 11. The float valve 14 usually comprises a float (now shown) and valve (not shown) provided between the float and connecting end of the supply hose 6. It is designed so that, when sufficient gelatin is supplied into the spreader box 10, the float in the float valve 14 rises to close the valve and thus allow a constant amount of gelatin to be always stored in the spreader box 10. The main body 11 and adjusting sheathing are respectively provided with a heater 15 to ensure the melting of the gelatin. At the bottom end of the main body 11, a slit-shaped discharge port 16 is formed between the main body 11 and bottom end of the adjusting sheathing 12 from which melted gelatin is discharged out of the spreader box 10.

The opening adjusting mechanism and other parts of this adjusting sheathing 12 will be described. Numerals 18 designate adjusting rods having a thread therearound, said adjusting rods 18 are screwed into female screws 19 installed integrally with the adjusting sheathing 12. Dials 20 are provided on the top ends of the adjusting rods 18 to rotate said adjusting rods 18 and the lower ends of the rods 18 form contact ends 21 which keep in contact with the reference ends 22 fixed to the main body 11. Numerals 23 indicate set springs which normally push the adjusting sheathing 12 downwardly. The numeral 24 is a rod guide formed on the main body 11. Between such adjusting sheathing 12 and main body 11, a dial gauge 26 for seeing the adjusting condition is provided. The main body of the dial gauge 26 is installed on the main body 11 of the spreader box 10, while the plunger 27 of the dial gauge 26 is in contact with the detecting projection 28 which moves together with the adjusting sheathing 12. Therefore, the dial gauge 26 is composed so that, for example, when its reference point is adjusted to zero at such a point where the discharge port 16 is closed completely, its completely closed condition is expressed as a certain numerical value. In this embodiment, since very minute adjustment of the gelatin discharge rate is required and even very slight inclination of the adjusting sheathing 12 is not possible, dial gauges 26 are provided on right and left sides of the adjusting sheathing 12. For mechanisms where little inclination of the adjusting sheathing 12 occurs or when the inclination, if any, is insignificant, only one dial gauge 26 may be provided at the center of the adjusting sheathing 12.

Figure 1:
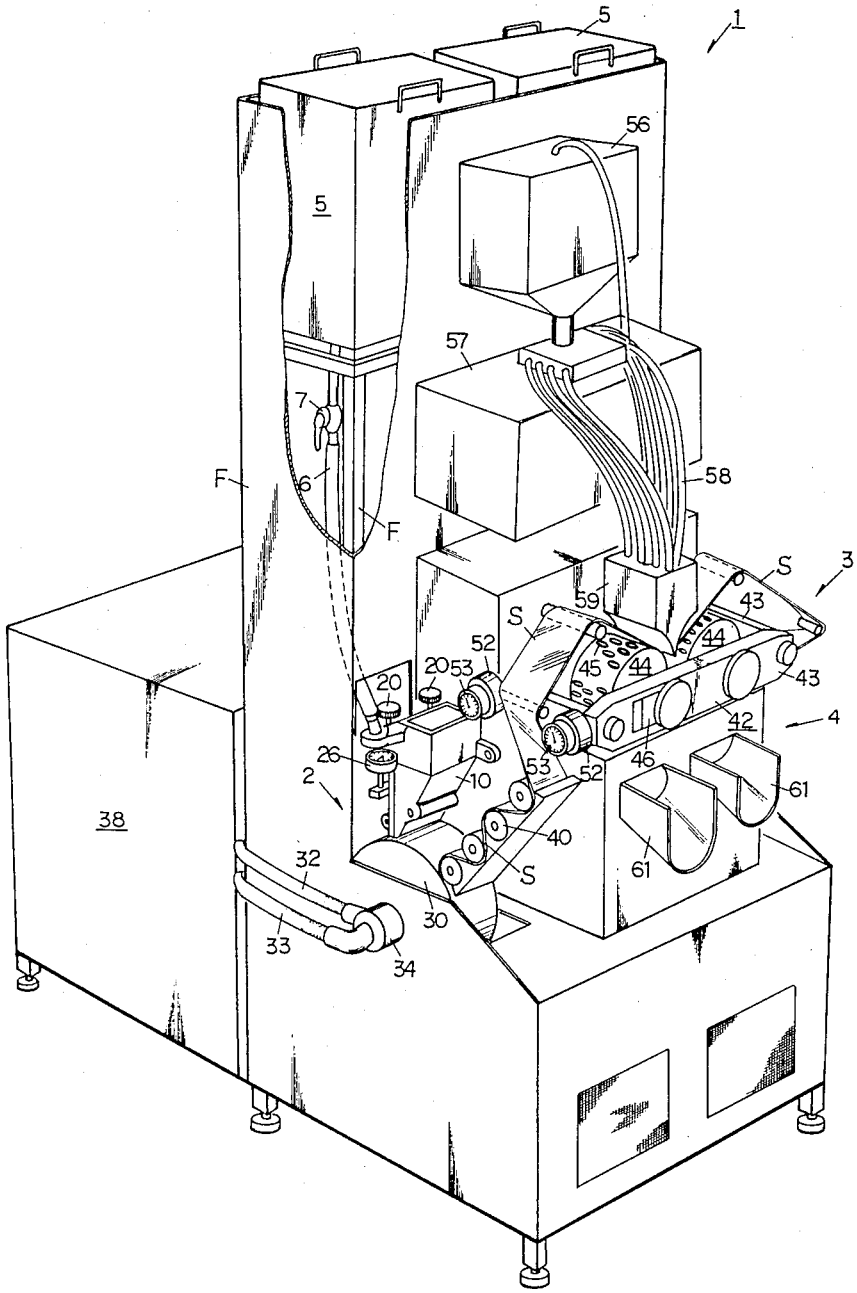
FIG. 1 is a perspective view of a gelatin capsule manufacturing apparatus according to this invention.

A cooling drum 30 is positioned below the spreader box 10. The drum 30 is supported to the frame F at the axis 31 so as to be rotated. The axis 31 is driven with a proper motor (not shown). The axis 31 is provided with a cooling medium supply means. Numeral 32 shows a cooling medium supply hose, and numeral 33 is a cooling medium recovery hose. These hoses 32 and 33 are connected to the coupling 34 and inserted onto the axis 31 to supply or recover the coolant. From each opening of the axis 31, a cooling medium discharge tube 35 and cooling medium recovery tube 36 extend into the cooling drum 30 through branch tubes **35*a*, 35*b*, 35*c*, 36*a*, 36*b*, and 36*c* respectively. The cooling medium is supplied from or recovered by a refrigerator unit 38 (FIG. 1). For the refrigerator unit 38**, general refrigeration units may be used and therefore detailed explanation is omitted here.

Components as described so far compose a sheet forming unit 2 and in the succeeding stage thereafter, that is, on the side to which the gelatin sheet S is supplied, a capsule forming unit 3 is provided and feed rollers 40 and reversal guides 41 (FIG. 3) are formed to relay therebetween. A gelatin sheet which has been cooled while going around the cooling drum 30 reaches the reversal guide 41 by passing through a plural number of feed rollers 40 in a zig-zaging manner and is supplied to the capsule forming unit 3.

Figure 9:
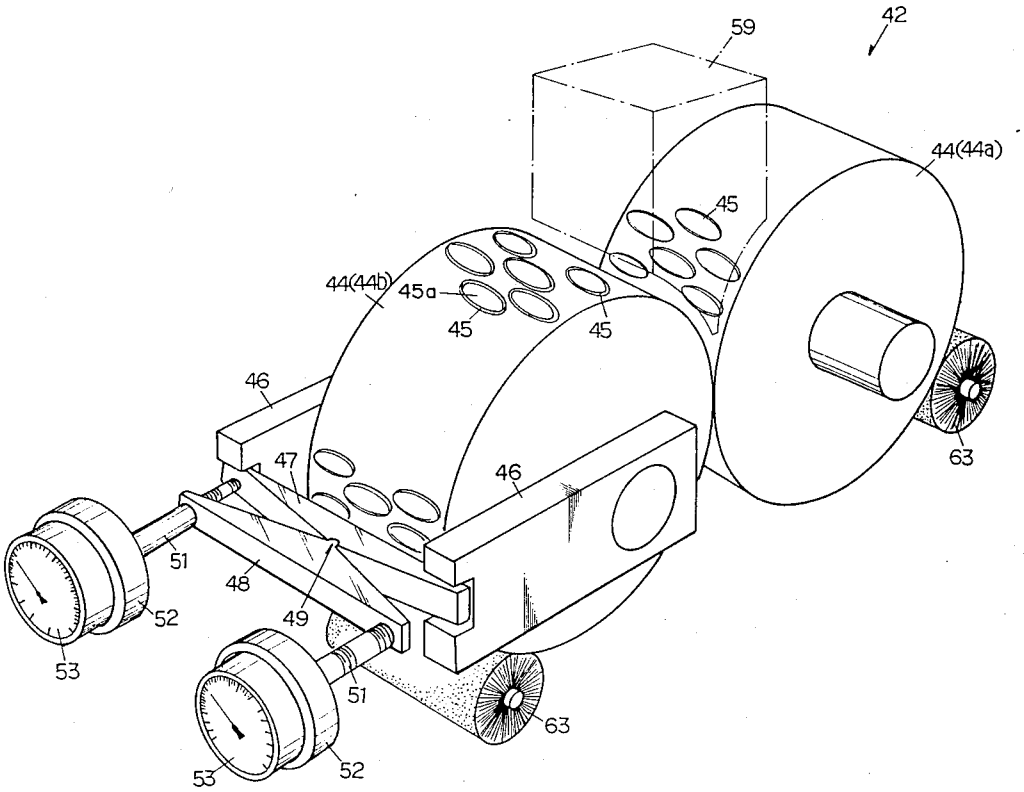
FIG. 9 is a perspective view showing part of the die head of the apparatus according to this invention.
Figure 10:
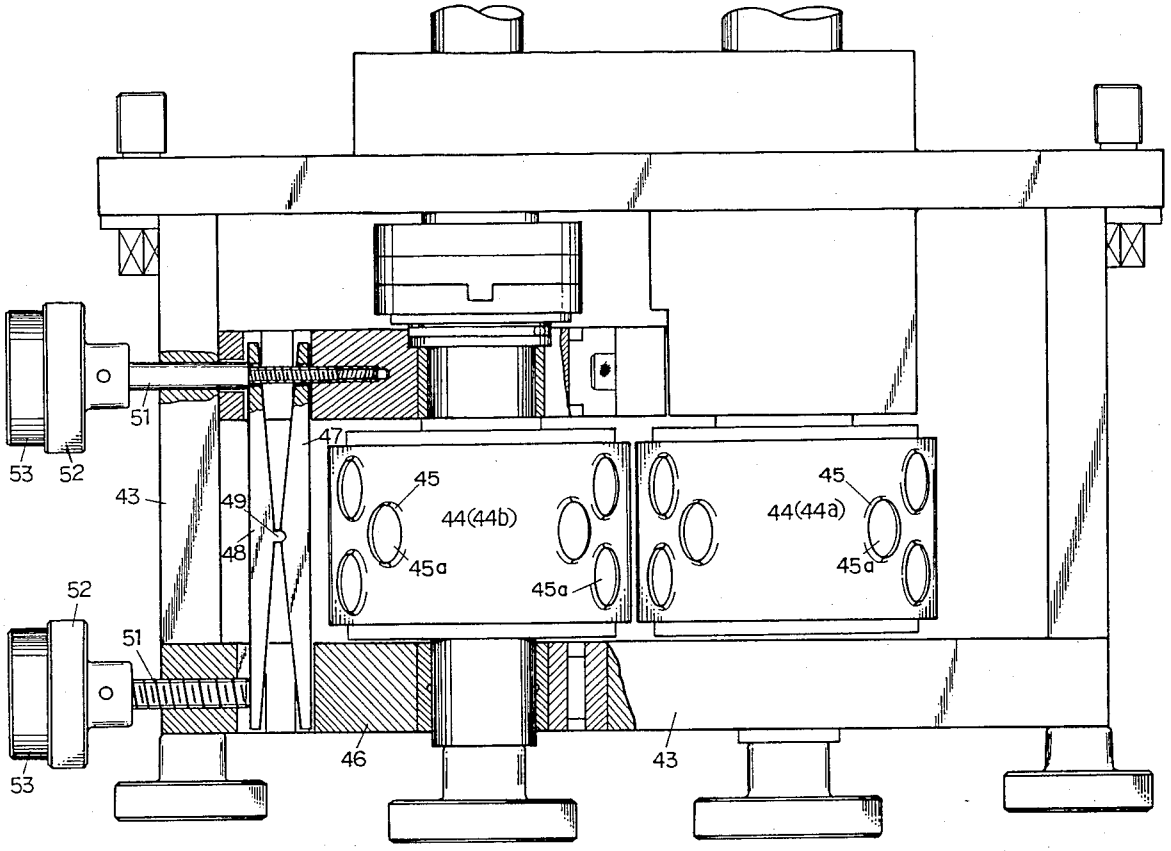
FIG. 10 is a plan of the die head.
Figure 11:
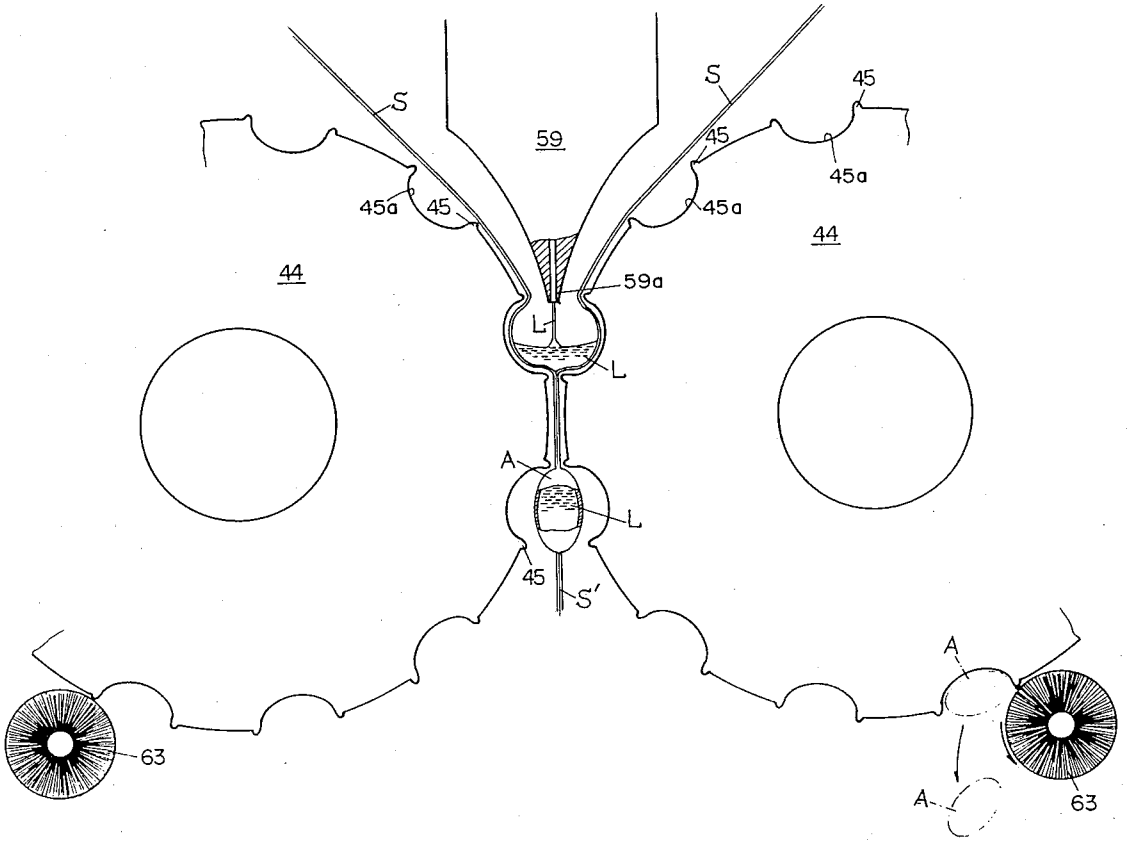
FIG. 11 is an operating diagram showing the capsule forming condition illustrating die rolls schematically.

The capsule forming unit 3 will be explained referring to FIGS. 9, 10, and 11. The numeral 42 shows a die head, a main member of the capsule forming unit 3. The die head comprises a pair of die rolls 44 provided for the die roll frame 43. One of the pair of the die rolls 44 is fixed and the other one can freely approach to the fixed die roll 44. When these two die rolls 44 should be distinguished for the purpose of explanation, one will be referred to as a fixed-side die roll 44 and the other as an adjustable-side die roll **44*b*. Each die roll 44 is formed with projections 45 and recesses 45*a*** on their surfaces.

For example, when forming an approximately spindle-shaped gelatin capsule A, its shape is elliptic with the center recessed.

The contact pressure adjusting mechanism of this die roll 44 will be described. In FIGS. 9 and 10, the bearing 46 of the adjustable-side die roll 44*b* is mounted to the die roll frame 43 in such a manner as to be able to freely slide towards and away from the fixed-side die roll 44*a*. A pair of leaf springs 47 and 48 function to urge the bearing 46. The pair of leaf springs 47 and 48 come into contact with each other at the central projecting contact area 49 and the leaf spring 47, which is close to the bearing 46, urges the bearing 46 to the fixed-side die roll 44*a* by bringing its ends into contact with the bearing 46. Adjusting push rods 51 are in contact with both ends of the other leaf spring 48. The adjusting push rods 51 are screwed into the die roll frame 43 and provided with adjusting dials 52 at their operating ends. It is constructed so that stronger contact pressure is obtained when the adjusting push rod 51 is screwed in more tightly. The contact pressure is numerically detected by the pushing pressure gauge 53.

A raw liquid supply system is explained with reference to FIGS. 1 to 3, and 11. The raw liquid supply system has a raw liquid hopper 56 to store the raw liquid therein. A pump unit 57 comprising suitable plunger pumps and others is provided below it to feed out raw liquid at a predetermined timing through a plural number of routes. The liquid reaches the raw liquid nozzle 59 through the delivery pipe 58 and is discharged. The raw liquid nozzle 59 has a tip 59*a*protruded so as to be inserted sufficiently between the die rolls 44 as shown in FIG. 11.

Figure 12:
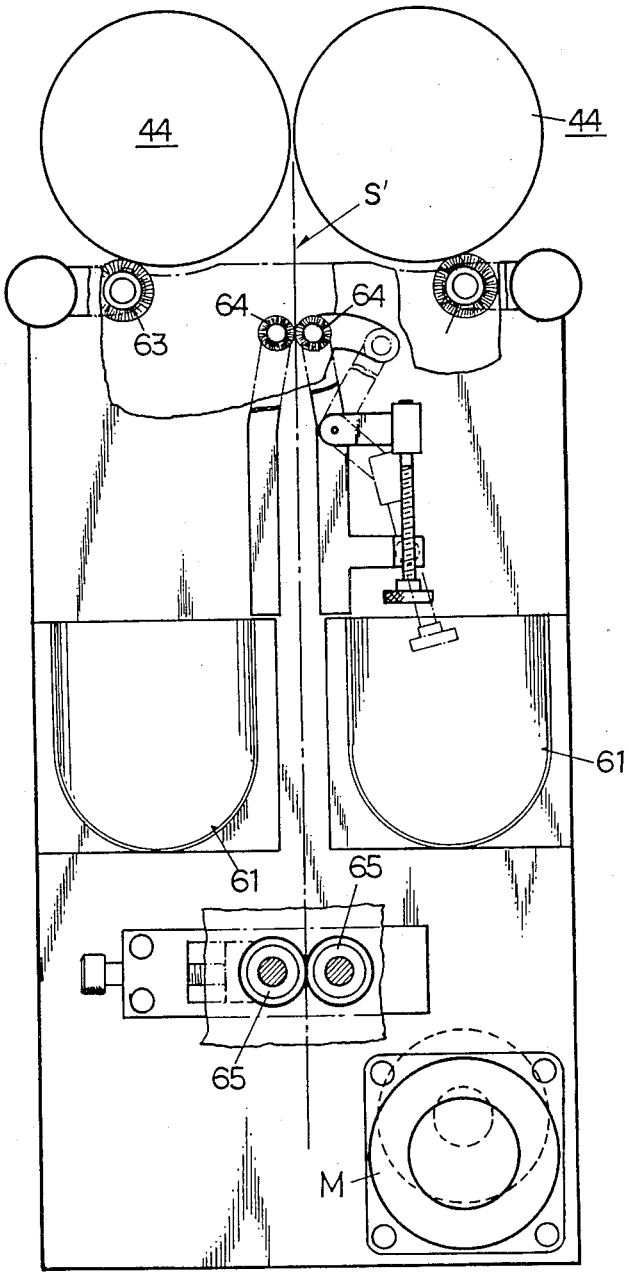
FIG. 12 is a front view showing the various component units of the take-out system.
Figure 13:
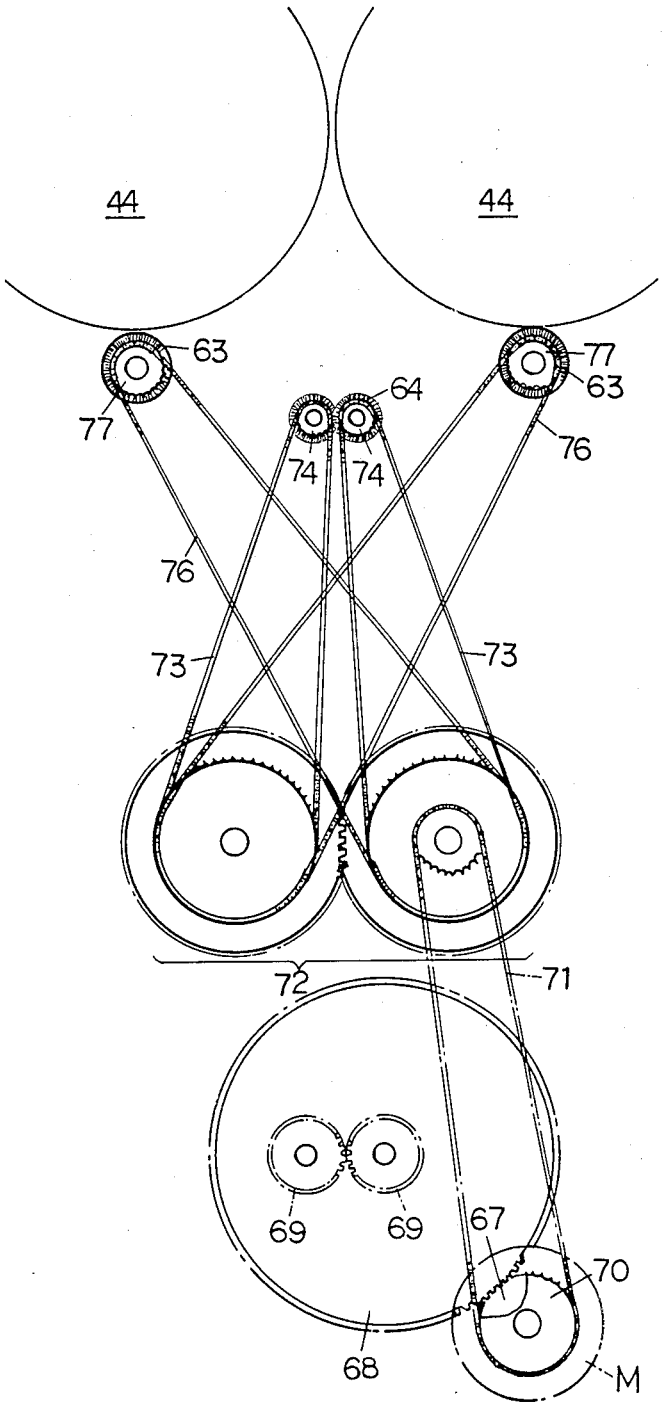
FIG. 13 is a front view showing the driving condition of the take-out system.

Units provided below the die rolls 44 and helpful for taking out the product, gelatin capsules A, will be explained referring to FIGS. 11, 12, and 13. Numeral 61 designates a gelatin capsule take-out trough which is to be pulled out to the front of the system from below the die rolls 44 (FIG. 1). A scraping brush 63 is in contact with the die roll 44 to rotate and take out gelatin capsules A caught between the forming projections 45 of the die rolls 44. It is anticipated that the gelatin capsules A will also remain on the blank sheet S'from which gelatin capsules A have been punched out and therefore blank sheet scraping brushes 65 and 65 to remove gelatin capsule A from the blank sheet S'are installed opposite to each other so as to hold the blank sheet S'therebetween. Below them, blank sheet feeding rolls 65 and 65 are provided to positively pull the blank sheet S'downward. The die roll scraping brushes 63 and 63, blank sheet scraping brushes 64 and 64, and blank sheet feeding rolls 65 and 65 in this embodiment are driven independently of other driving systems.

This driving system will be explained hereunder. The symbol M indicates a take-out unit motor. As shown in FIG. 13, its rotating force is transmitted to blank sheet feeding roll gears 69 through a output gear 67 and an idle gear 68. The blank sheet feeding roll gears 69 are engaged with each other when the pair of blank sheet feeding rolls 65 provided opposite rotate in opposite directions. An output sprocket 70 is provided coaxially with the output gear 67, a chain 71 is installed on the output sprocket 70 and rotational force is transmitted to the relay reduction unit 72 through this chain 71. The relay reduction unit 72 is constructed so that its pair of reduction gears rotate in opposite directions as in the blank sheet feeding roll gears 69 and the rotational force is transmitted via chains 73 to the sprockets 74 so as to drive the blank sheet scraping brushes 64. The rotational force is further transmitted to the sprockets 77 installed on the die roll scraping brushes 63 via another chain 76. This transmission system is provided with a known chain tension mechanism and other known suitable systems but such systems are not described here.

This invention is actualized as an apparatus described above. Now its operation will be described below.

(i) Gelatin sheet S forming process

Figure 7:
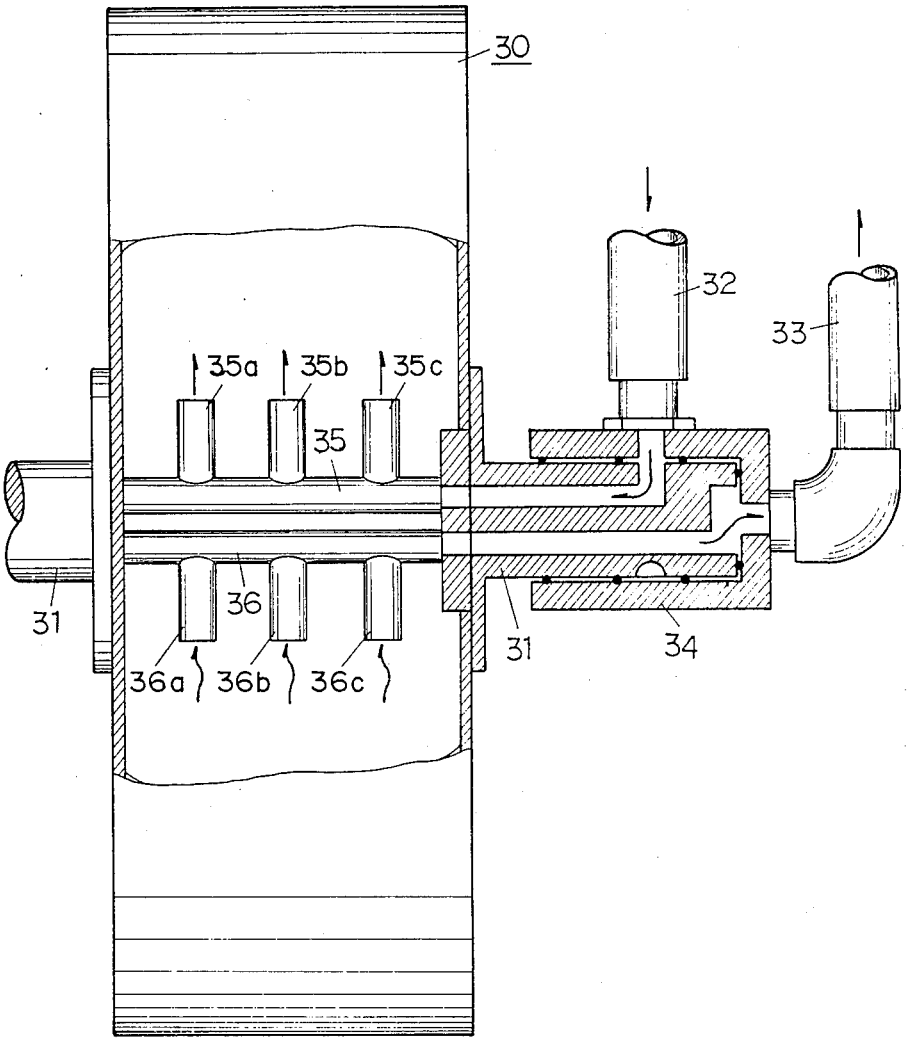
FIG. 7 is a sectional view of a cooling drum of the said apparatus.
Figure 8:
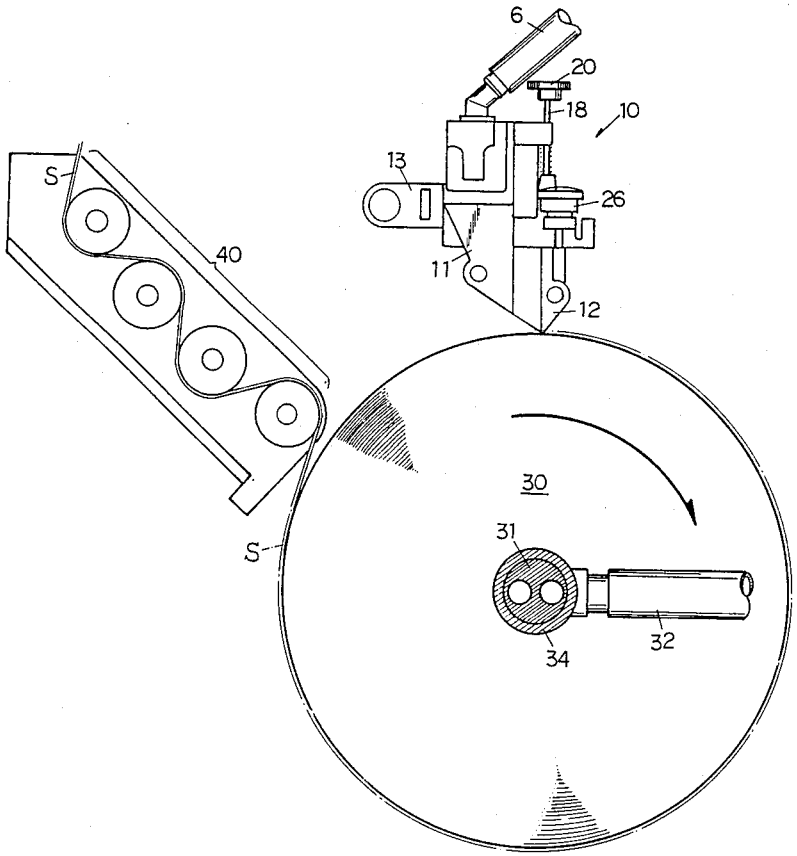
FIG. 8 is a side view of the cooling drum.

When forming gelatin sheet S, gelatin which has been sufficiently melted in the gelatin tank 5 is supplied to the spreader box 10 when the valve 7 of the supply hose 6 is opened as shown in FIGS. 1 to 6. If not gelatin is stored in the spreader box 10 at this time, melted gelatin flows in to fill the spreader box 10 with gelatin gradually since the float valve 14 is opened. When a certain amount of gelatin has flowed into the spreader box 10 the float valve 14 is closed. When the adjusting sheathing 12 is adjusted to a proper predetermined position, melted gelatin flows out at a certain pressure from a discharge port 16 formed between the lower end of the adjusting sheathing 12 and the lower end of the main body 11 and the gelatin is coated on the surface of the cooling drum 30. The setting of the gelatin thickness is very important at this time. For this reason, the adjusting rods 18 are rotated with the dials 20 to adjust the setting height of the adjusting sheathing 12 to the main body 11. In other words, the lower contact ends 21 of the adjusting rods 18 are in contact with the reference ends 22 on the main body 11. By screwing it in, the female screws 19 on the adjusting sheathing 12 rise and the adjusting sheathing 12 is adjusted. This adjusting amount is numerically expressed on the dial gauges 26. Therefore, by providing various numerical data, the thickness of the gelatin sheet S and other conditions can be conveniently adjusted based on this data so that even not skilled workers can adjust it better. The gelatin sheet S discharged onto the surface of the cooling drum 30 in this way is sufficiently brought onto the surface of the rotating cooling drum 30 and then cooled and fed out to the feed roll 40. For cooling this cooling drum 30, cooling media, such as cooling solution or freon gas, etc., from the refrigerator unit 38 is discharged into the cooling drum 30 through the coolant supply hose 32, coupling 34, cooling medium discharge tube 35, and branch tubes 35*a*, 35*b*, 35*c* as shown in FIG. 7, and then recovered from the recovery tube 36 through the recovery branch tubes 36*a*, 36*b*, and 36*c*, thus sufficiently cooling the cooling drum 30. The heat of the sheet-formed gelatin which was discharged onto the surface of the cooling drum 30 is exchanged here to be cooled sufficiently and supplied to the capsule forming unit 3 at desired viscosity.

(ii) Capsule forming process

The gelatin sheet S which is supplied as described above is turned for example in this embodiment about 90° by a reversing guide 41 and reaches the capsule forming unit 3. In other words, the gelatin sheet S is inserted between a pair of die rolls 44 and 44 in the capsule forming unit 3 as shown in FIG. 11. On the other hand, the end 59*a*of the raw liquid nozzle 59 is positioned at this inserting portion and a certain amount of raw liquid is discharged between two gelatin sheets A. The discharging timing is adjusted naturally so that the forming projections 45 of the die rolls 44 are brought into contact with each other, which allows capsules to be formed in the recess 45*a* on the internal periphery of the forming projections 45 and filled with raw liquid. At this time, adjusting of the contact pressure is very important when bringing the forming projections 45 of the pair of die rolls 44 and 44 into contact. It is accomplished by the following procedure. A worker turns the adjusting dials 52 as shown in FIGS. 9 and 10 respectively. For example, when the adjusting dials 52 are screwed in, the adjusting push rods 51 push both ends of the leaf spring 48, its pressure is transmitted from the central contact area 49 of the leaf spring 48 to the central contact area 49 of the other leaf spring 47, and then the pressure of the leaf spring 47 is transmitted at both ends thereof to the bearing 46 of the adjustable-side die roll 44*b*. This pushing pressure is numerically indicated on the pushing pressure gauges 53 installed together with the adjusting dials 52. Therefore, by totalizing this numerical data, even workers who are not skilled can make ideal adjustments.

(iii) Gelatin capsule A recovery process

Gelatin capsules A formed in this way are recovered from the take-out trough 61 provided below the die rolls 44. At this time, the formed gelatin capsules A may not have been completely separated from the die rolls 44 or blank sheet S'. They are recovered by the following procedure. First, the die roll scraping brushes 63 and 63 are driven by the take-up unit motor M and rotated in reverse directions respectively to the die rolls 44 with which they are in contact to scrape off gelatin capsules A which have got into the recess 45*a* of the forming projections 45. Then the gelatin capsules A remaining on the blank sheet S'are swept up in the opposite direction to the blank sheet S'running direction (downward in this embodiment) by the blank sheet scraping brushes 64 and 64, and gelatin capsules A formed from the blank sheet S'are taken out. At this time, for more positive removal of the blank sheet S', the blank sheet S'is held between the blanksheet feeding roll 65 and 65 and pulled actively downward. The die roll scraping brushes 63 and 63, blank sheet scraping brushes 64 and 64, and blank sheet feeding rolls 65 and 65 are driven completely independently from other driven units such as die rolls 44 and 44, cooling drum 30, etc. It allows for independent adjustment or inspection of the components of the take-up system and a more efficient adjusting procedure.

As described above, according to this invention, cooling media supplied into the gelatin sheet cooling drum 30 cools gelatin sheet when it is formed. Therefore, it is unnecessary to blow cooling air, etc. specifically to cool gelatin sheets and thus the cost of cooling is remarkably reduced. In addition, since no cooling air, etc. is supplied, gelatin sheet S can be manufactured in a very clean environment.

What is claimed is:

1. An apparatus for manufacturing gelatin capsules comprising:

a gelatin sheet forming means which allows a predetermined amount of melted gelatin to flow continuously onto a rotary drum, cools the gelatin on the drum while transmitting it, and forms the gelatin into a sheet shape, wherein said rotary drum is a cooling drum and into which cooling media has been supplied;

a gelatin capsule forming means to supply objects to be contained in the capsule between two gelatin sheets formed by said gelatin sheet forming means while supplying the two gelatin sheets between a pair of die rolls having capsules forming dies on the surface thereof and form gelatin capsules containing said object, the pair of die rolls of said gelatin capsule forming means being disposed so that one die roll is urged against the other, and a pressure gauge to numerically indicate the pressure being provided for the said gelatin capsule forming means; and a gelatin capsule recovery means to recover gelatin capsules formed by the gelatin capsule forming means.

2. An apparatus of claim 1 in which said gelatin sheet forming means is providd with a gauge to numerically indicate the flow rate of melted gelatin onto the said rotary drum.

3. An apparatus of claim 1 in which the said gelatin capsule recovery means comprises a first capsule scraping rotary brush disposed so as to be in contact with said each die roll, second capsule scraping rotary brush disposed in the said blank sheet moving route so as to be in contact with the blank sheet after capsules have been punched out, blank sheet feeding rolls to pull out the said blank sheet while holding it therebetween, and a driving means for driving the first and second rotary brushes and feeding rolls, said driving means being independent of a driving mechanism for said die roll.

4. A method for manufacturing gelatin capsules comprising:

a step which allows a predetermined amount of melted gelatin to flow continuously onto a rotary drum, cool the gelatin on the said drum with the rotary drum into which cooling media has been supplied while transferring the gelatin on the said drum with this rotary drum and form the gelatin into sheet form;

a step to supply objects to be contained in the capsules between two gelatin sheets while supplying said two gelatin sheets between a pair of die rolls having capsule forming dies on the surface thereof, and form gelatin capsules containing the said objects, the pair of die rolls of said gelatin capsule forming means being disposed so that one die roll is ured against the other, and numerically measuring the pressure provided by the capsule forming means; and a step to recover the formed gelatin capsules.

5. The method according to claim 4, further comprising a step of recovering the formed gelatin capsules by scraping with rotary brushes each die roll and the blank sheet after punching out the capsules, the blank sheet being held in position by feeding rolls, said rotary brushes and said feeding rolls being driven independently of said die rolls.

6. An apparatus for manufacturing gelatin capsules comprising:

a gelatin sheet forming means which allows a predetermined amount of melted gelatin to flow continuously onto a rotary drum, cools the gelatin on the drum while transmitting it, and forms the gelatin into a sheet shape, wherein said rotary drum is a cooling drum and into which cooling media has been supplied;

a gelatin capsule forming means to supply objects to be contained in the capsule between two gelatin sheets formed by said gelatin sheet forming means while supplying the two gelatin sheets between a pair of die rolls having capsule forming dies on the surface thereof and form gelatin capsules containing said object; and a gelatin capsule recovery means to recover gelatin capsules formed by the gelatin capsule forming means, said cooling drum comprises a hollow inner space therein, an axis rotatably supporting said drum, said axis having, respectively, a first through hole and a second through hole therein, and at least two tubes provided on said axis, one end of one of said two tubes being opened to said hollow inner space of said drum, the other end of said one tube being operatively connected to said first through hole of said axis, and one end of the other of said two tubes being opened to said hollow inner space of said drum, the other end of said other tube being operatively connected to said second through hole of said axis, whereby said one tube and said first through hole of said axis form a supplying path for supplying a cooling medium into said hollow inner space of said drum, and said other tube and said second through hole of said axis form a recovering path for recovering said cooling medium from said hollow inner space.

7. An apparatus for manufacturing gelatin capsules comprising:

a gelatin sheet forming means which allows a predetermined amount of melted gelatin to flow continuously onto a rotary drum, cools the gelatin on the drum while transmitting it, and forms the gelatin into a sheet shape, wherein said rotary drum is a cooling drum and into which cooling media has been supplied;

a gelatin capsule forming means to supply objects to be contained in the capsule between two gelatin sheets formed by said gelatin sheet forming means while supplying the two gelatin sheets between a pair of die rolls having capsule forming dies on the surface thereof and form gelatin capsules containing said object, the pair of die rolls of said gelatin capsule forming means being disposed so that one die roll is urged against the other, and a pressure gauge to numerically indicate the pressure being provided for the said gelatin capsule forming means; and a gelatin capsule recovery means to recover gelatin capsules formed by the gelatin capsule forming means, said cooling drum comprises a hollow inner space therein, an axis rotatably supporting said drum, said axis having, respectively, a first through hole and a second through hole therein, and at least two tubes provided on said axis one end of one of said two tubes being opened to said hollow inner space of said drum, the other end of said one tube being operatively connected to said first through hole of said axis, and one end of the other of said two tubes being opened to said hollow inner space of said drum, the other end of said other tube being operatively connected to said second through hole of said axis, whereby said one tube and said first through hole of said axis form a supplying path for supplying a cooling medium into said hollow inner space of said drum, and said other tube and said second through hole of said axis form a recovering path for recoverng said cooling medium from said hollow inner space.

* * * * *